US007583913B2

(12) United States Patent
Komoda et al.

(10) Patent No.: US 7,583,913 B2
(45) Date of Patent: Sep. 1, 2009

(54) RECORDING MEDIUM CONVEYING UNIT AND IMAGE FORMING APPARATUS HAVING RECORDING MEDIUM REVERSING UNIT

(75) Inventors: Nobuhito Komoda, Tokyo (JP); Junji Nakai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/350,746

(22) Filed: Feb. 10, 2006

(65) Prior Publication Data

US 2006/0127130 A1 Jun. 15, 2006

Related U.S. Application Data

(63) Continuation of application No. 10/927,131, filed on Aug. 27, 2004, now Pat. No. 7,031,640.

(30) Foreign Application Priority Data

Aug. 27, 2003 (JP) ..... 2003-302983

(51) Int. Cl.
*G03G 15/00* (2006.01)

(52) U.S. Cl. ..... 399/124

(58) Field of Classification Search ..... 399/401, 399/124, 107

See application file for complete search history.

(56) References Cited

U.S. PATENT DOCUMENTS

| | | | | |
|---|---|---|---|---|
| 4,843,214 | A | 6/1989 | Higashi et al. | |
| 4,873,554 | A | 10/1989 | Greco, Jr. | |
| 4,942,434 | A | 7/1990 | Nakai et al. | |
| 5,331,374 | A | 7/1994 | Abe et al. | |
| 5,694,638 | A | 12/1997 | Maruyama et al. | |
| 5,797,068 | A | 8/1998 | Otsuki et al. | |
| 5,832,354 | A | 11/1998 | Kouno et al. | |
| 5,839,044 | A * | 11/1998 | Taruki | 399/361 |
| 5,915,147 | A | 6/1999 | Kouno et al. | |
| 6,366,747 | B1 * | 4/2002 | Roller | 399/110 |
| 6,641,132 | B2 | 11/2003 | Sekine | |
| 6,726,197 | B2 | 4/2004 | Aoki | |
| 2003/0209852 | A1 * | 11/2003 | Choi | 271/291 |
| 2004/0109704 | A1 * | 6/2004 | Abe | 399/107 |
| 2004/0228650 | A1 * | 11/2004 | Saito | 399/107 |
| 2005/0082747 | A1 * | 4/2005 | Tamura et al. | 271/184 |

FOREIGN PATENT DOCUMENTS

| | | |
|---|---|---|
| JP | 2-149861 | 6/1990 |
| JP | 05-035008 | 2/1993 |
| JP | 10-339979 | 12/1998 |
| JP | 11-052814 | 2/1999 |
| JP | 11-249530 | 9/1999 |
| JP | 2000-086094 | 3/2000 |
| JP | 2000-198574 | 7/2000 |
| JP | 2003-146528 | 5/2003 |
| JP | 2004053653 A * | 2/2004 |

* cited by examiner

*Primary Examiner*—Quana M Grainger
(74) *Attorney, Agent, or Firm*—Oblon, Spivak, McClelland, Maier & Neustadt, P.C.

(57) ABSTRACT

A pair of resist rollers, a transferring device, a fixing device, a recording medium discharging device, and a recording medium reversing device are integrated into a recording medium conveying unit. The recording medium conveying unit can be drawn out of a main unit of an image forming apparatus.

8 Claims, 3 Drawing Sheets

RECORDING MEDIUM CONVEYING UNIT AND IMAGE FORMING APPARATUS HAVING RECORDING MEDIUM REVERSING UNIT

CROSS-REFERENCE TO RELATED APPLICATIONS

The present document incorporates by reference the entire contents of Japanese priority document, 2003-302983 filed in Japan on Aug. 27, 2003.

BACKGROUND OF THE INVENTION

1) Field of the Invention

The present invention relates to a recording medium conveying unit and an image forming apparatus.

2) Description of the Related Art

In a conventional image forming apparatus, a transferring device transfers a toner image formed on an image bearing body to a recording medium delivered by a resist device. A fixing device fixes the toner image on the recording medium. A recording medium discharging device ejects to a discharge tray the recording medium bearing the fixed toner image. The image forming apparatus here refers to a multifunction product performing the functions of an electronic photocopying machine, a printer, and a facsimile or at least a combination of two of these.

The conventional image forming apparatuses have a structure that allow the recording medium to be easily released, should jamming occur, by providing a transferring device, fixing device, and recording medium discharging device, each of which can be independently drawn out of the main unit of the image forming apparatus. If jamming of the recording medium occurs when the recording medium is stretched across the transferring device and the fixing device, if only the transferring device is drawn out while the fixing device is still inside the main unit, there is a risk of the recording medium getting damaged due to the recording medium being still caught in the fixing device. Therefore, to correct this drawback, an image forming apparatus (see Japanese Patent Laid-Open Publication No. H2-149861 (Page 4, FIG. 1, and FIG. 3)) is provided in which the transferring device, the fixing device, and the recording medium discharging device form a single recording medium conveying unit that can be drawn out as a unit. This structure precludes the risk of releasing the recording medium from just one part, and leaving it caught in another part and thus damaging it.

However, some image forming apparatuses can form images on both sides of a recording medium. Once a toner image on a front surface is fixed, the recording medium is reversed and another toner image is formed on a back surface of the recording medium. These apparatuses are provided with a recording medium reversing device that delivers the recording medium once again to the resist device. If jamming of the recording medium occurs in such an image forming apparatus when the recording medium is stretched across the fixing device and the recording medium reversing device, there is a risk of the recording medium getting damaged because the recording medium reversing device remains inside the main unit of the image forming apparatus when the recording medium conveying unit is drawn out to release the jamming.

SUMMARY OF THE INVENTION

It is an object of the present invention to solve at least the problems in the conventional technology.

A recording medium conveying unit according to an aspect of the present invention that can be drawn out of and pushed back into a main unit of an image forming apparatus and includes a resist unit that delivers a recording medium to an image bearing body at a predetermined time so that a toner image formed on the image bearing body is transferred to the recording medium; a fixing unit that fixes on the recording medium delivered by the resist unit the toner image formed on the image bearing body; a transferring unit that transfers the toner image formed on the image bearing body; a recording medium discharging unit that discharges to a recording medium discharge tray the recording medium bearing a fixed toner image; and a recording medium reversing unit that reverses the recording medium bearing the fixed toner image on a first surface so that a toner image may be formed on a second surface, and delivers the recording medium once again to the resist unit.

An image forming apparatus according to an aspect of the present invention includes the above recording medium conveying unit.

The other objects, features, and advantages of the present invention are specifically set forth in or will become apparent from the following detailed description of the invention when read in conjunction with the accompanying drawings.

DETAILED DESCRIPTION

Exemplary embodiments of a recording medium conveying unit and an image forming apparatus according to the present invention will be explained below while referring to the accompanying drawings.

Figure 1:
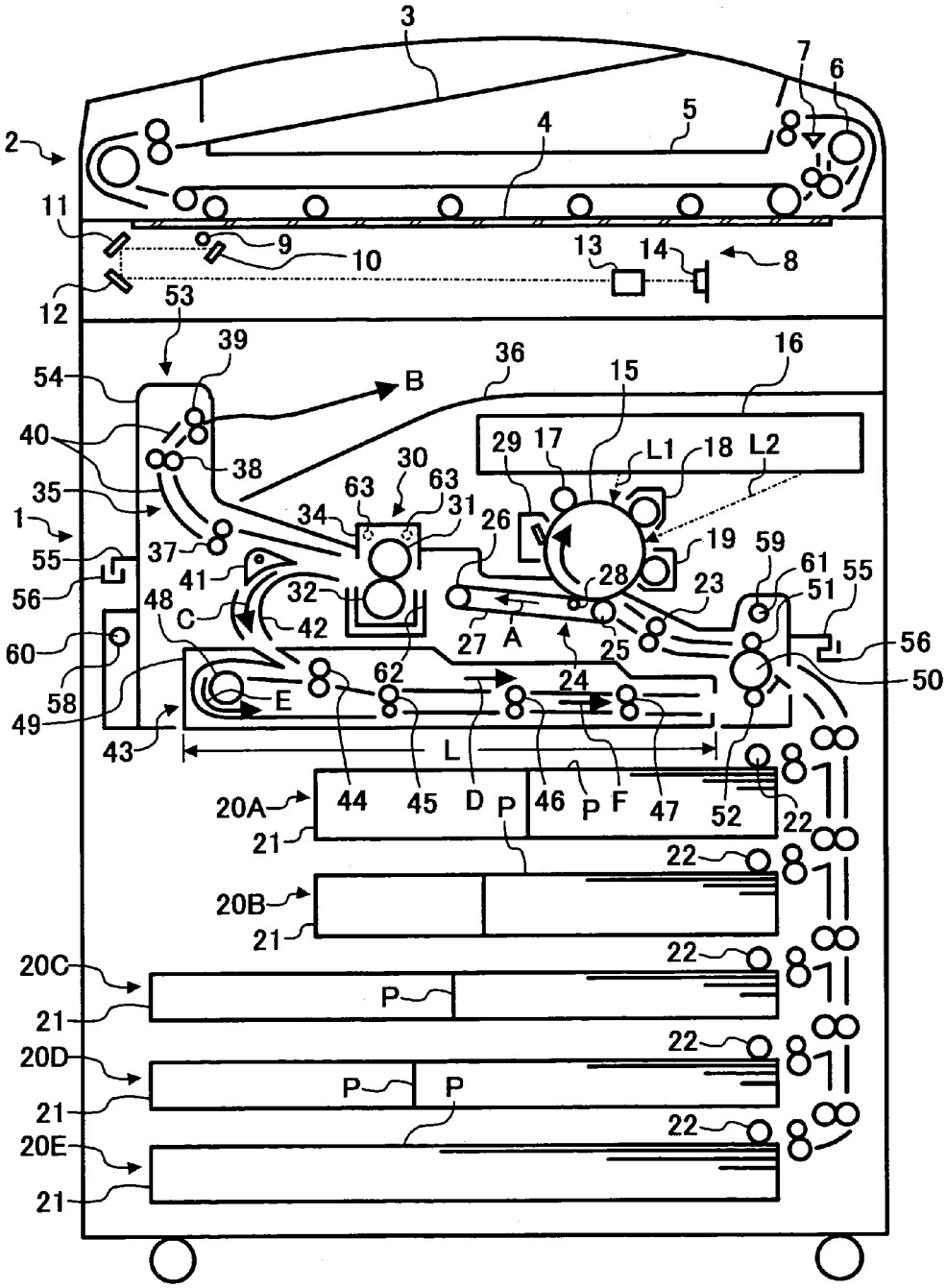
FIG. 1 is a vertical cross section of an image forming apparatus according to an embodiment of the present invention.

FIG. 1 is a vertical cross section of an image forming apparatus according to an embodiment of the present invention. The image forming apparatus includes a main unit 1 and an automatic document feeder 2 mounted on the main unit 1. The main unit 1 houses a recording medium conveying unit, which is described later, and various other devices. The bold lines in FIG. 1 represent cross-section.

The automatic document feeder 2 feeds documents (not shown) placed in a document feeding tray 3, one document at a time, to a contact glass 4 disposed on upper side of the main unit 1 and discharges the document to a discharge tray 5 once an image is scanned on it.

When scanning images from both the surfaces of the document, the document delivered from the document feeding tray 3 moves over the contact glass and is re-fed to the contact glass 4 jointly by a roller 6 and a reversing nail 7. An image is scanned on one surface of the document on the contact glass 4. Once the scanning on the first surface is completed, the document is re-fed to the contact glass 4 jointly by the roller 6 and the transfer nail 7. This time an image is scanned on the other surface of the document. Subsequently, the document is discharged to the discharge tray 5.

The main unit 1 includes an optical scanning system 8 provided beneath the contact glass 4. The optical scanning system 8 includes an exposure lamp 9, a first mirror 10, a second mirror 11, a third mirror 12, a lens 13, and a photoelectric converter made of a charge-coupled device (CCD)

14. When scanning an image on the document, a not shown stepping motor moves the exposure lamp 9 and the first mirror 10 at a constant speed in a sub-scanning direction, that is, towards the right in FIG. 1, and light from the exposure lamp 9 exposes the image on the document set on the contact glass 4. The stepping motor also moves the second mirror 11 and the third mirror 12, but at half the speed of the exposure lamp 9 and the first mirror 10. The first mirror 10, the second mirror 11, and the third mirror 12 reflect the light on the document and the reflected light passes through the lens 13. The image on the document is formed on an acceptance surface of the CCD 14 and a photoelectric conversion takes place.

The main unit 1 also includes an image bearing body 15 in the form of a photosensitive drum, and an optical writing unit 16. During image formation, the image bearing body 15 is driven to turn in a clockwise direction in FIG. 1. A charging device 17 charges the entire surface of the image bearing body 15 to a uniform polarity. A black laser light L1, which is optically modulated according to the image information scanned by the optical scanning system 8, emitted by the optical writing unit 16 exposes the surface of the charged image bearing body 15, forming a latent image on the image bearing body 15. A black developing device 18 develops the latent image into a visible black toner image. Next, a red laser light L2, emitted by the optical writing unit 16, exposes the surface of the image bearing body 15 and forms a latent image. A red developing device 19 develops this latent image into a visible red toner image.

Sheet feeders 20A through 20E are provided below the main unit 1. Each of the sheet feeders 20A through 20E includes a feeding tray 21 and a feed roller 22. The feeding tray 21 houses recording medium P, which may be transfer sheets or a resin films. One of the feeding devices 20A through 20E is selected and the feed roller 22 rotates and delivers the topmost sheet of the recording medium P from the feeding tray 21.

The recording medium delivered by the feed roller 22 is conveyed to the conveying rollers 50 and 51. The conveying rollers 50 and 51 transfer the recording medium to a pair of resist rollers 23, which is an example of a resist device. Upon coming in contact with the resist rollers 23, the recording medium halts briefly. Once the resist rollers 23 start rotating at a predetermined time, the recording medium is conveyed towards the image bearing body 15. A transferring device 24 transfers the toner image on the image bearing body 15 to the recording medium. In this way, the resist device rotates at a predetermined time and delivers the recording medium to the image bearing body so that the toner image formed on the image bearing body is transferred to the recording medium.

The transferring device transfers the toner image formed on the image bearing body to the recording medium delivered by the resist device. The transferring device may be of any form. However, the transferring device shown in FIG. 1 includes a plurality of support rollers 25 and 26, a transfer belt 27 that is stretched across and is supported by the support rollers 25 and 26 and is driven in the direction indicated by the arrow A, and a bias member 28 disposed on the inner surface of the transfer belt 27 substantially facing the image bearing body 15. When the transfer belt 27 carries the recording medium to the image bearing body 15, a transfer voltage is applied on the bias member 28 by which the toner image on the image bearing body 15 is transferred to the recording medium.

A cleaning device 29 removes the toner left over on the image bearing body 15 after the transfer of the toner image and a not shown neutralizing device resets the voltage on the surface of the image bearing body 15.

The recording medium leaves the transfer belt 27 and passes through a fixing device 30. The fixing device 30 shown in FIG. 1 is only an example and includes a fixing roller 31 and a pressure roller 32, which rotate against one another, a not shown heater provided inside the fixing roller 31, and a casing 34 that houses and rotatably supports the fixing roller 31 and the pressure roller 32. When the recording medium passes between the fixing roller 31 heated by the heater and the pressure roller 32, the toner image on the recording medium is fixed to the recording medium by application of heat and pressure.

Figure 2:
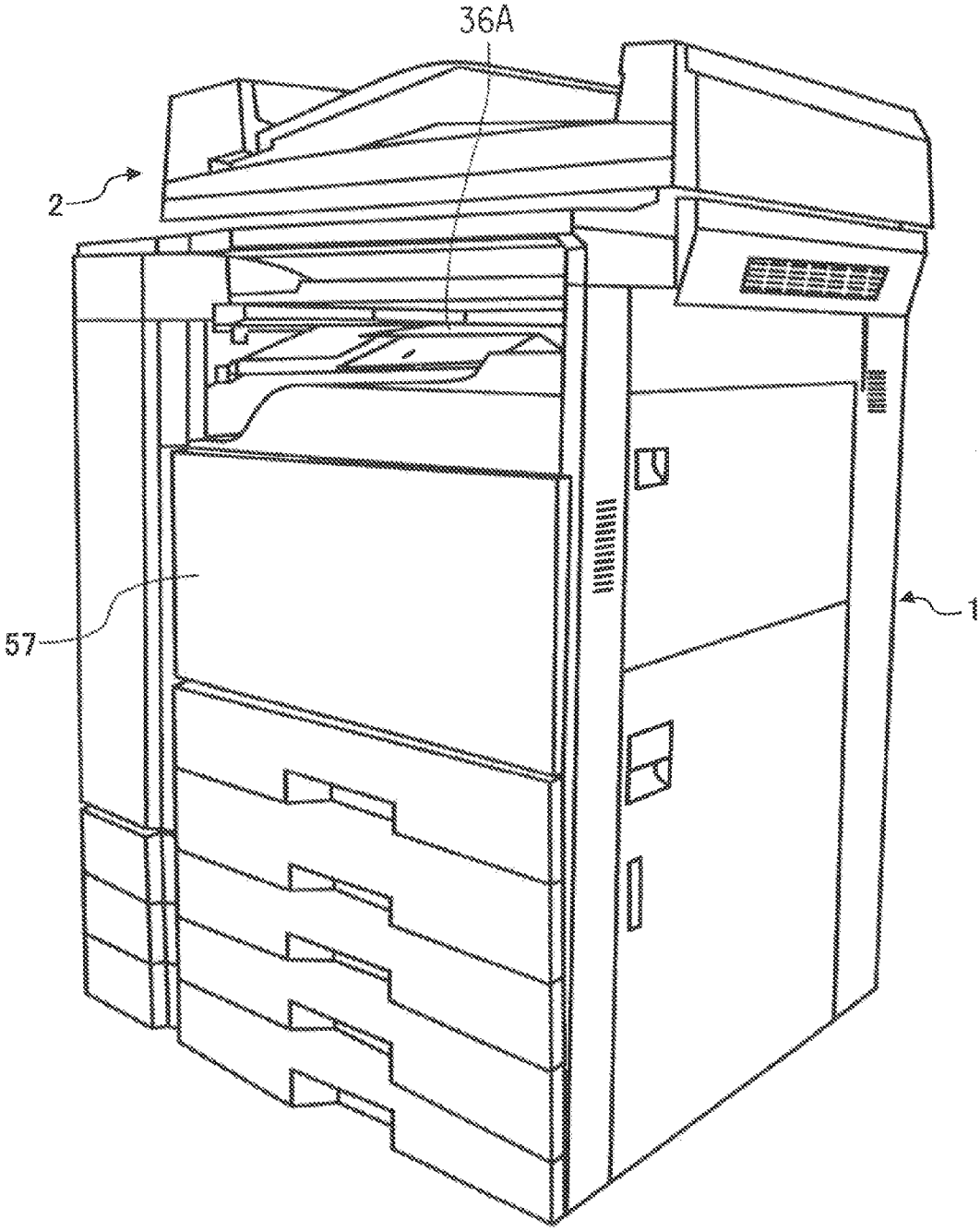
FIG. 2 is a perspective of the image forming apparatus.

After passing through the fixing device 30, the recording medium is discharged by a recording medium discharging device 35 in the direction indicated by the arrow B and is stacked on a recording medium discharge tray 36. The recording medium discharging device 35 shown in FIG. 1 includes a set of conveying rollers 37, 38, and 39, and guide plates 40. Thus, the recording medium bearing a fixed toner image is discharged by the recording medium discharging device 35 on a recording medium discharging tray 36, and can be removed via the front opening 36A (FIG. 2).

The image forming apparatus has a two-surface mode in which it allows image formation on both the surfaces of the recording medium. In the two-surface mode, by the switching of a switching nail 41 provided between the fixing device 30 and the recording medium discharging device 35, the recording medium emerging out of the fixing device 30 is guided by a guide plate 42 in the direction indicated by the arrow C into a recording medium reversing device 43.

The recording medium reversing device 43 shown in FIG. 1 is only an example and includes a pair of inlet rollers 44, a plurality of pairs of conveying rollers 45 through 47 arranged substantially horizontally, a reversing roller 48, and a casing 49 that houses and rotatably supports the inlet rollers 44, the conveying rollers 45 through 47, and the reversing roller 48. The recording medium is conveyed through the inlet rollers 44 over the top rollers of the conveying rollers 45 through 47 in the direction indicated by the arrow D. The top rollers of the conveying rollers 45 through 47 rotate clockwise.

The top rollers of the conveying rollers 45 through 47 and the inlet rollers 44 now turn counter-clockwise, causing the recording medium to be conveyed in the direction opposite to the direction indicated by the arrow D. The reversing roller 48 conveys the recording medium in the direction indicated by the arrow E. The conveying rollers 45 through 47 then convey the recording medium in the direction indicated by the arrow F. Thus, the recording medium is flipped to the reverse side. The conveying rollers 50, 52, and 51 convey the recording medium that emerges from the recording medium reversing device 43 once again to the resist rollers 23, where the recording medium halts briefly. The subsequent steps are identical to the steps of toner image formation on the first surface. That is, the transferring device 24 transfers the toner image from the image bearing body 15 to the second surface of the recording medium following which the recording medium passes through the fixing device 30 and is discharged to the recording medium discharge tray 36 by the recording medium discharging device 35.

Thus, the recording medium reversing device reverses the recording medium that emerges from the fixing device so that a toner image may be formed on the second surface and delivers the recording medium once again to the resist device.

The resist rollers 23 that form the resist device, the transferring device 24, the fixing device 30, the recording medium discharging device 35, and the recording medium reversing device 43 are fitted as a single recording medium conveying unit 53 that can be drawn out of or pushed back into the main unit 1. In FIG. 1, the recording medium conveying unit 53 is supported against the main unit 1 in such a way that it can be drawn out in a substantially orthogonal direction with respect to the conveying direction of the recording medium, that is, substantially orthogonal to the surface of the sheet on which FIG. 1 appears on the near side, and pushed back in the opposite direction.

To be more specific, the resist rollers 23 that form the resist device, the transferring device 24, the fixing device 30, the recording medium discharging device 35, and the recording medium reversing device 43 are fitted as a unit in a unit frame 54, forming a recording medium conveying unit 53. In FIG. 1, the guide plates 40, 42, and other guide plates are integral with the unit frame 54. Two movable guide rails 55 are secured, one on each side of the unit frame 54. Each movable rail 55 is swingably secured to a fixed guide rail 56 secured to the main unit 1.

Figure 3:
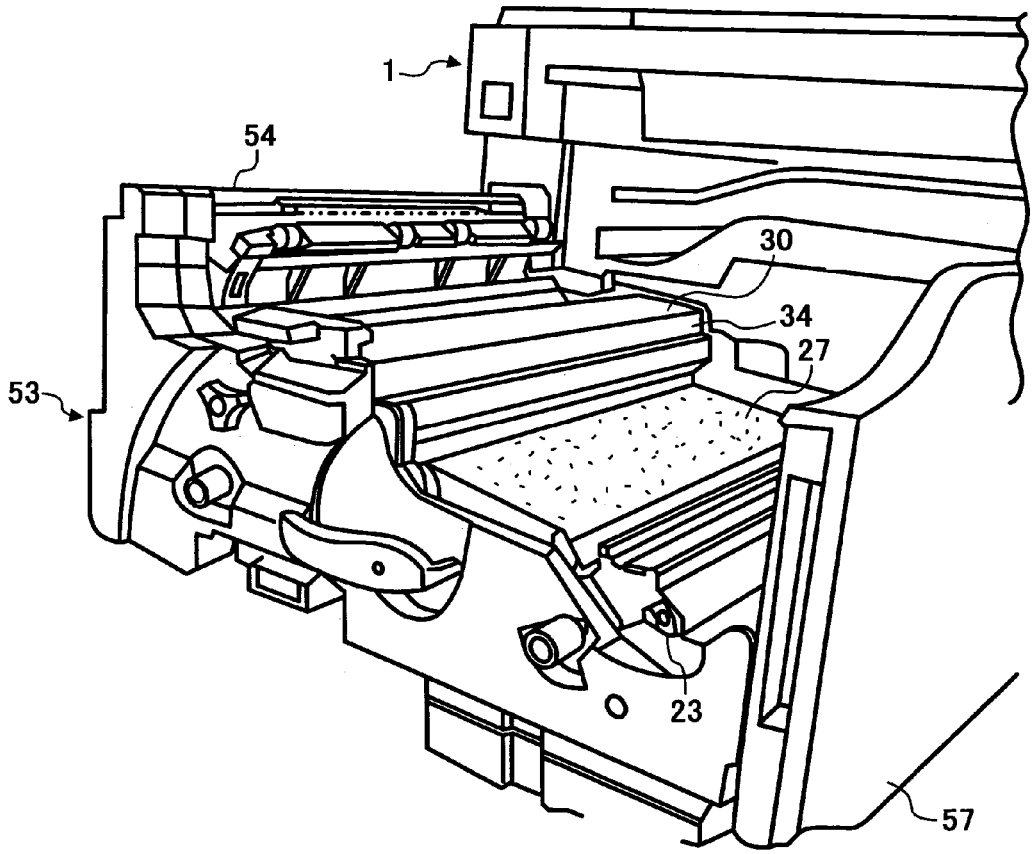
FIG. 3 is a perspective of a recording medium conveying unit drawn out of a main unit of the image forming apparatus.

FIG. 2 is an oblique view of the image forming apparatus. A front door 57 on the near side of the main unit 1 is supported to swivel open and close. Let us suppose that jamming of the recording medium has occurred while on the recording-medium conveying unit 53, causing the image formation process of the image forming apparatus to halt. To release the jammed recording medium, the front door shown in FIG. 3 is first opened to draw out the recording medium conveying unit 53. The drawing causes the movable guide rails 55 secured to the unit frame 54 of the recording medium conveying unit 53 to slide against the fixed guide rails 56 secured to the main unit 1, making it possible to draw the entire recording medium conveying unit 53 out of and in front of the main unit 1. In this way, the resist device, the transferring device 24, the fixing device 30, the recording medium discharging device 35, and the recording medium reversing device 43 that form the recording medium conveying unit 53 are all exposed, making it easy to release the jammed recording medium. Further, even if jamming of the recording medium has occurred between any two of these devices, the recording medium can be released without any damage since these devices, namely, the resist device, the transferring device 24, the fixing device 30, the recording medium discharging device 35, and the recording medium reversing device 43, are fitted as a unit and can be drawn out of the main unit 1 as a unit. Thus, this structure allows the jamming of the recording medium to be released even more effectively.

Further, a structure may be provided wherein, when no image formation is taking place, the fixing roller 31 and the pressure roller 32 of the fixing device 30 are separated by a not shown driving device, and the transfer belt 27 of the transferring device 24 is not in contact with the image bearing body 15. In such a structure, jamming of the recording medium leads to the separation of the fixing roller 31 and the pressure roller 32 as well as separation of the transfer belt 27 and the image bearing body 15. This facilitates easy release of the jammed recording medium once the recording medium conveying unit 53 is drawn out of the main unit 1.

After releasing the jammed recording medium, the recording medium conveying unit 53 is pushed back into the main unit 1. As shown in FIG. 1, positioning slots 58 and 59 provided on the unit frame 54 engage into positioning pins 60 and 61 protruding from the side walls at the far end of the main unit 1. Once the recording medium conveying unit 53 is engaged into the main unit 1, image formation process can be restarted after closing the front door 57 as shown in FIG. 2.

The unit frame 54 of the recording medium conveying unit 53 and the guide plates 40 and 42 may be formed from resin. As compared to a metal structure, this helps reduce the overall weight of the recording medium conveying unit 53, making it easier to draw it out and push it in.

It is preferable to use a transparent material, such as a transparent resin, for at least a part of, and preferably, the entire unit frame 54. This enables the user to visually ascertain if jamming has indeed taken place when the recording medium conveying unit 53 is drawn out of the main unit 1. The guide plates 40 and 41 should also be preferably made of a transparent material.

Further, as shown in FIG. 1, the fixing device 30 may be detachably fitted into the unit frame 54. This structure enables easy replacement of the fixing device 30. To be specific, a pocket 62 may be provided in the unit frame 54 into which the fixing device 30 can be detachably engaged. When the recording medium conveying unit 53 is pushed back into the main unit 1, positioning pins 63 located at the far end of the casing 34 of the fixing device 30 engage into the positioning slots provided on the side walls at the far end of the main unit 1, securing the fixing device 30 in the main unit 1.

Similarly, the transferring device 24 may also be detachably fitted into the unit frame 54 to make it easier to replace.

A structure may be provided wherein the recording medium reversing device 43 is supported such that it can be shifted downward with respect to the unit frame 54 once the recording medium conveying unit 53 is drawn out of the main unit 1. This facilitates the release of the jammed recording medium. For instance, the recording medium 43 and the unit frame 54 may be connected with the aid of not shown pivot pins provided at the far end of each side of the casing 49 of the recording medium reversing device 43. When the recording medium conveying unit 53 is drawn out of the main unit 1, the recording medium reversing device 43 can be pivoted around the pivot pins, and the parts of the recording medium reversing device 43 at the near end can be shifted downward.

Apart from the recording medium conveying unit 53, the image forming apparatus according to the present example includes a plurality of sheet feeders 20A through 20E, each of which feed a recording medium P of a different size to the resist device formed by the resist rollers 23. The size of the recording medium in the conveyance direction represents the length of the recording medium. The length of the longest recording medium from among the recording mediums being used is set as the length L of the recording medium reversing device 43.

If the length L of the recording medium reversing device 43 is set greater than the length of the longest recording medium, the recording medium reversing device 43 can reverse even the longest recording medium, enabling toner image formation on the reverse surface of the recording medium. However, there are other elements, such as the conveying roller 50, etc., next to the recording medium reversing device 43. Therefore, if the length L of the recording medium reversing device 43 is set greater than the length of the longest recording medium being used, the width of the main unit 1 in the horizontal direction in FIG. 1 will become very large.

Therefore, the length L of the recording medium reversing device 43 is kept less than the length of the longest recording medium being used. In this structure, the recording medium reversing device 43 cannot reverse the longest recording medium, and hence no toner image can be formed on the reverse surface of the longest recording medium. This is a trade-off for achieving compactness of the model.

In the example described so far the image forming apparatus has an image bearing body which itself is a light-sensitive body. However, the present invention can also be adapted to an image forming apparatus in which the image bearing body is an intermediate transfer body to which the toner image is transferred from a light-sensitive body. Apart from photocopying machines, the present invention can also be applied to other image forming apparatuses such as printers, facsimiles, or multifunction products that include these devices.

According to the present invention, it is possible to prevent damage to a recording medium in the event of jamming of the recording medium in either a recording medium reversing device or other devices next to the recording medium reversing device.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a reading unit that reads documents, wherein the reading unit is disposed at an upper portion of a main body of the apparatus;

a plurality of sheet feeders that stores a recording medium, wherein the feeders are disposed at an lower portion of the apparatus;

a unit frame that is capable of being drawn out forward with respect to the main body of the apparatus, wherein the unit frame is disposed between the reading unit and the sheet feeders;

a recording medium discharging tray on which the recording medium discharged from a conveying unit is stacked, wherein the recording medium discharging tray is disposed between the reading unit and the unit frame; and an optical writing unit that emits a laser light for exposing the image bearing body, wherein the optical writing unit is disposed between the tray and the unit frame, wherein:

a resist unit that delivers the recording medium to an image bearing body at a predetermined time so that a toner image formed on the image bearing body is transferred to the recording medium;

a fixing unit that fixes on the recording medium delivered by the resist unit the toner image formed on the image bearing body;

a transferring unit that transfers the toner image formed on the image bearing body;

a recording medium discharging unit that discharges to the recording medium discharge tray the recording medium bearing a fixed toner image; and a recording medium reversing unit that reverses the recording medium bearing the fixed toner image on a first surface so that a toner image may be formed on a second surface, and delivers the recording medium once again to the resist unit, are assembled to the unit frame in one piece, a switching nail disposed between the fixing unit and the recording medium discharging unit, wherein the recording medium discharging tray is oriented with a slope that ascends from upstream to downstream with respect to the discharging direction of the recording medium, wherein the switching nail is disposed under the ascending slope.

2. The image forming apparatus according to claim 1, wherein the recording medium reversing unit is disposed below the unit frame; and the resist unit, and the transferring unit are disposed above the recording medium reversing unit.

3. The image forming apparatus according to claim 2, wherein the recording medium reversing unit includes a plurality of conveying rollers which are arranged substantially horizontally.

4. The image forming apparatus according to claim 1, wherein the recording medium reversing unit is disposed below the unit frame; and the resist unit, the transferring unit, and the fixing unit are disposed above the recording medium reversing unit.

5. The image forming apparatus according to claim 4, wherein the recording medium reversing unit includes a plurality of conveying rollers which are arranged substantially horizontally.

6. The image forming apparatus according to claim 1, wherein the recording medium reversing unit includes a plurality of conveying rollers which are arranged substantially horizontally.

7. The image forming apparatus according to claim 1, wherein the plurality of sheet feeders, the recording medium reversing unit, the recording medium discharging tray, and the optical writing unit are disposed within a width of the reading unit.

8. The image forming apparatus according to claim 1, further comprising wherein the switching nail switches conveying direction of the recording medium to either the recording medium discharging unit or the recording medium reversing unit.

* * * * *